US007322265B2

(12) United States Patent
Chen

(10) Patent No.: US 7,322,265 B2
(45) Date of Patent: Jan. 29, 2008

(54) COMPOUND SCREWDRIVER HEAD

(76) Inventor: Hang-Hui Chen, #5, Alley 15, Ln 32, Sec 1, Yongsing Rd, Beitou, Taipei (TW) 112

( * ) Notice: Subject to any disclaimer, the term of this patent is extended or adjusted under 35 U.S.C. 154(b) by 96 days.

(21) Appl. No.: 11/306,712

(22) Filed: Jan. 9, 2006

(65) Prior Publication Data

US 2007/0157773 A1 Jul. 12, 2007

(51) Int. Cl.
*B25B 15/00* (2006.01)
*B25B 23/00* (2006.01)

(52) U.S. Cl. ..... 81/460; 81/436

(58) Field of Classification Search ..... 81/436, 81/460, 461; 7/165

See application file for complete search history.

(56) References Cited

U.S. PATENT DOCUMENTS

| | | | | |
|---|---|---|---|---|
| 2,317,319 | A * | 4/1943 | West | 81/438 |
| 2,366,682 | A * | 1/1945 | West et al. | 81/460 |
| 2,400,684 | A * | 5/1946 | Clark | 81/460 |
| 3,207,196 | A * | 9/1965 | Stillwagon, Jr. | 408/229 |
| 4,325,153 | A * | 4/1982 | Finnegan | 7/165 |
| 6,128,983 | A * | 10/2000 | Arnn | 81/460 |
| 6,378,406 | B1 * | 4/2002 | Totsu | 81/460 |
| 6,397,710 | B1 * | 6/2002 | Baker | 81/460 |
| 6,584,876 | B2 * | 7/2003 | Totsu | 81/460 |
| 7,077,038 | B2 * | 7/2006 | Toyooka et al. | 81/460 |
| 2002/0029666 | A1 * | 3/2002 | Totsu | 81/460 |
| 2003/0159551 | A1 * | 8/2003 | Hughes | 81/460 |
| 2005/0172762 | A1 * | 8/2005 | Suzuki | 81/460 |

* cited by examiner

*Primary Examiner*—David B Thomas
(74) *Attorney, Agent, or Firm*—Shia, Banger

(57) ABSTRACT

A compound screwdriver head, which comprises a first working portion and a second working portion of the same size, the first, second working portion of the bigger size is used for screwing and unscrewing a bolt of bigger, smaller size respectively, so that different sizes of bolts can be locked and unloaded by one screwdriver. Thereby this invention is not only can save the structure of the bolt, but also can prolong the life of the bolt.

19 Claims, 6 Drawing Sheets

COMPOUND SCREWDRIVER HEAD

FIELD OF THE INVENTION

The present invention relates to a screwdriver head, and more particularly to a compound screwdriver head.

DESCRIPTION OF THE PRIOR ART

FIG. 1 is a perspective view of a conventional cross-shaped screwdriver head, which comprises a body 10 having a working section 11. The working section 11 includes four working surfaces 12, four working grooves 14 are formed in the working section 11, and the top end 13 of the working section 11 is cross-shaped so as to screw and unscrew the bolt of the same size as the screwdriver head.

However, the conventional screwdriver head is only suitable for a size of bolt, when using for screwing and unscrewing the bolts of other sizes, it is needed to use other sizes of screwdriver head, so it is very inconvenient.

It is feasible to screwing and unscrewing every size of bolts of a single screwdriver head, however, since the material of the bolt is softer than that of the bolt, when using a screwdriver of bigger size for screwing and unscrewing a bolt of small size, the screw groove of the bolt will be damaged and the life of the bolt will be reduced.

The present invention has arisen to mitigate and/or obviate the afore-described disadvantages.

SUMMARY OF THE INVENTION

The primary objective of the present invention is to provide a compound screwdriver head, which is integrally formed and can screw and unscrew every size of screws.

Another objective of the present invention is to provide a compound screwdriver head, which is integrally formed and not only can screw and unscrew every kind of screws, but also cannot damage the bolt groove of the bolt so as to prolong the life of the bolt.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
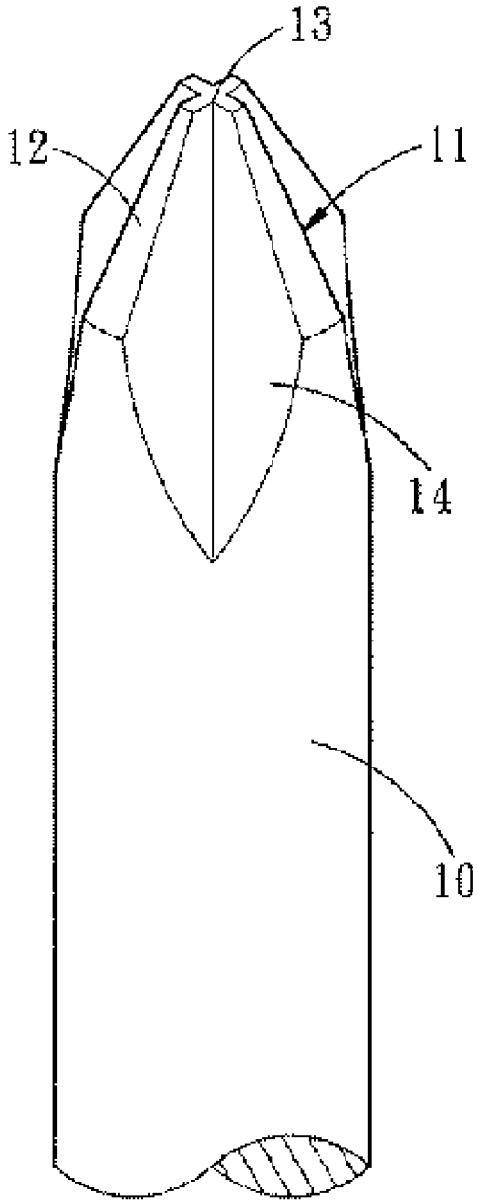
FIG. 1 PRIOR ART
FIG. 1 is a perspective view of a conventional cross-shaped screwdriver head.
Figure 2:
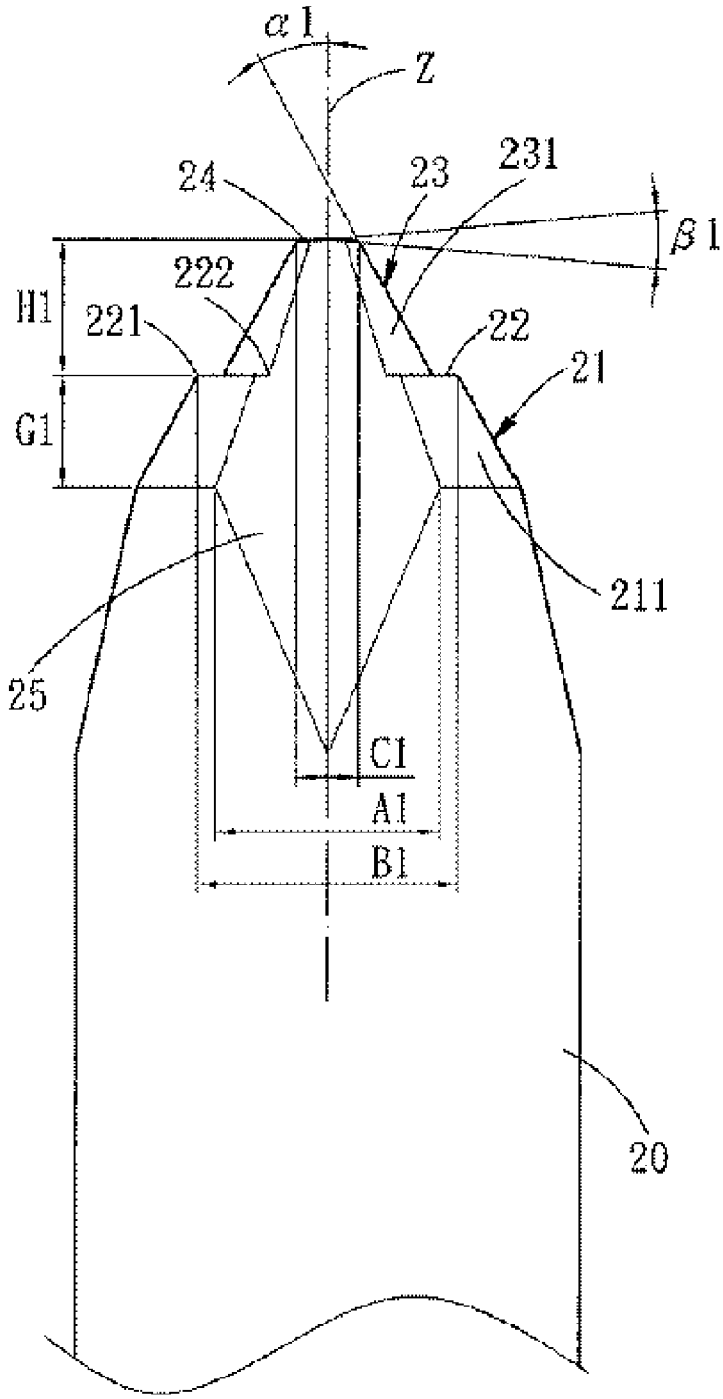
FIG. 2 is a lateral view of a compound cross-shaped screwdriver head in accordance with the present invention.

Referring to FIG. 2, a compound screwdriver head in accordance with the present invention comprises a body 20, a first working portion 21, a connecting surface 22, a second working surface 23, an awl portion 24 and a plurality of working grooves 25. One end of the first working portion 21 is connected with the body 20, and the other end is connected with an outer ring 221 of a plurality of connecting surfaces 22. An inner ring 222 of the connecting surface 22 is connected with the second working portion 23. The size of the outer ring 221 is larger than that of the inner ring 222, and the awl portion 24 is formed on the end of the connecting surface 22, the working grooves 25 are extended from the awl portion 24 to the first working portion 21 via the second working portion 23.

The said compound screwdriver head, wherein the size of the working grooves of the first and the second working portions 21, 23 are different, since the first and second working portions 21, 23 are integrally formed, the bolts of different sizes can be screwed and unscrewed.

Furthermore, the compound screwdriver head in accordance with the present invention, wherein the angle of the awl portion 24 is suitable for the groove of the bolt of small size. When screwing and unscrewing the bolt of small size, the screw lines of the bolt will not be damaged so as to prolong the life of the bolt.

Figure 3:
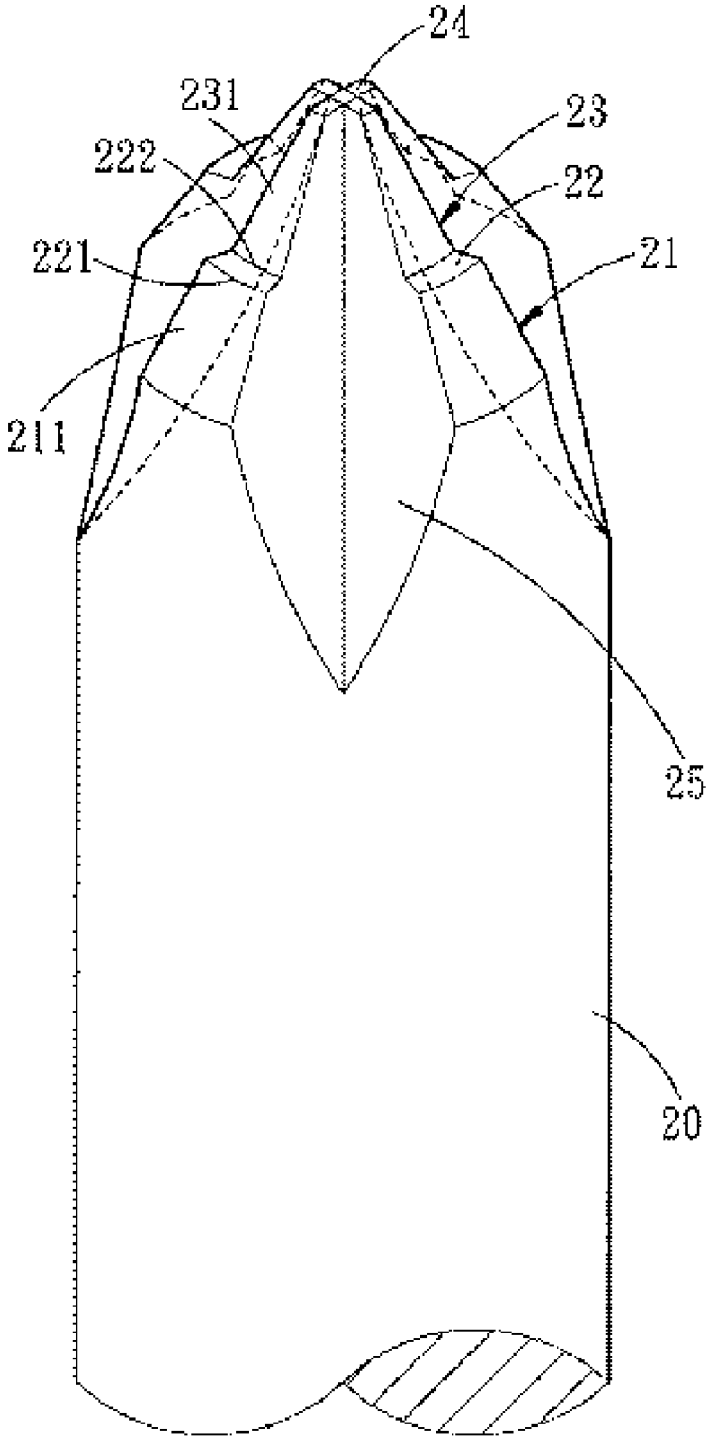
FIG. 3 is a perspective view of the compound cross-shaped screwdriver head in accordance with the present invention.

Referring to FIGS. 2 and 3, FIG. 2 is a side view of a compound cross-shaped screwdriver head in accordance with the present invention, and FIG. 3 is a perspective view of the compound cross-shaped screwdriver head in accordance with the present invention.

A compound cross-shaped screwdriver head is integrally formed, comprising the cylindrical body 20, the first working portion 21, the connecting surface 22, the second working portion 23, the awl portion 24 and the working groove 25.

The first working portion 21 is formed on the cylindrical body 20, including four abutting surfaces 211 that formed an angle of 28 degree relative to the center line Z of the body 20 respectively. Each two abutting surfaces 211 are equidistantly separated, which are relative to each other. The end of each first abutting surface 211 is connected with the connecting surface 22 that vertical to the center line Z of the body 20 respectively, the connecting surface 22 includes the outer ring 221 and the inner ring 222. The outer ring 221 is connected with the first abutting surface 211 of the first working portion 21, and the radius of the outer ring 221 is bigger than that of the inner ring 222.

The inner ring 222 of the connecting surface 22 is connected with a second abutting surface 231 of the second working portion 23. Similarly, the second working portion 23 includes four second abutting surfaces 231 that are equidistantly separated from one another and arranged oppositely in pairs.

An awl portion 24, defined in the second working portion 23, is a square shaped pyramid. On each awl surface is formed a working groove 25, which is extended from the awl portion 24 to the first working portion 21 and then to the body 20 via the second working portion 23, the awl portion 24 is cross-shaped by overlooking from the upper side.

The included angles a1 between the first abutting surface 211 and the center line Z of the body 20 is 26 to 30 degree preferably, and 28 degree optimally; the angle a1 formed between the second abutting surface 231 and the center line Z of the body 20 is 26 to 30 degree preferably, and 28 degree optimally. The height G1 and H1 of the first and second working portions 21, 23 are 1.85 to 2.15 mm and 1.95 to 2.35 preferably, and 1.9 to 2.1 mm and 2.0 to 2.3 mm optimally. The width A1 of the connecting portion of the first working portion 21 and the body 20 that connected with the groove surface of the working groove 25 is 3.0 to 4.1 mm preferably, and 3.5 to 3.6 mm optimally. The biggest width B1 of the outer ring 221 of the adjacent connecting surfaces 22 is 3.8 mm to 5.0 mm preferably, and 4.3 to 4.5 mm optimally. The angle β1 of the awl portion 24 is 5 to 15 degree preferably, and the optimal is 10 degree. The size C1 of the top end of the awl portion 24 is 1.1 to 1.2 mm preferably.

Figure 4:
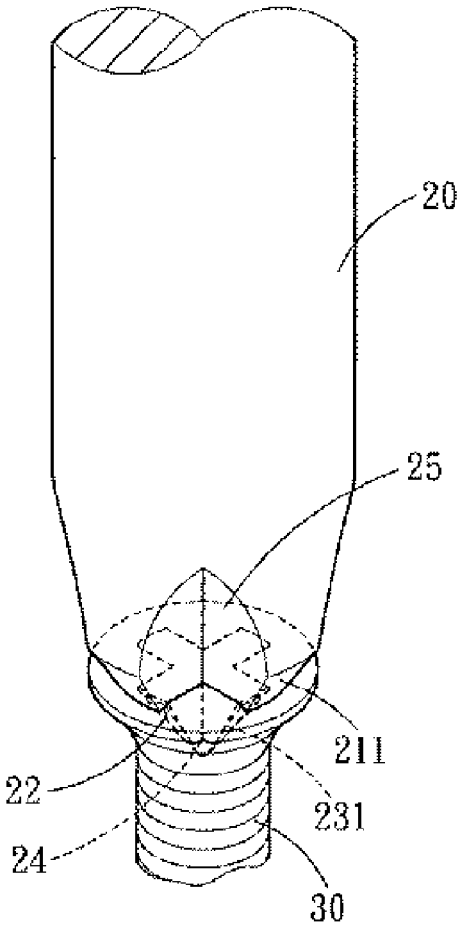
FIG. 4 is a perspective view of showing the compound cross-shaped screwdriver head locking and unlocking a small bolt.

The screwing and unscrewing of the small bolt as shown in FIG. 4, the second abutting surface 231 of the second working portion 23 is engaged with the screw groove of a small bolt 30 for screwing and unscrewing.

Figure 5:
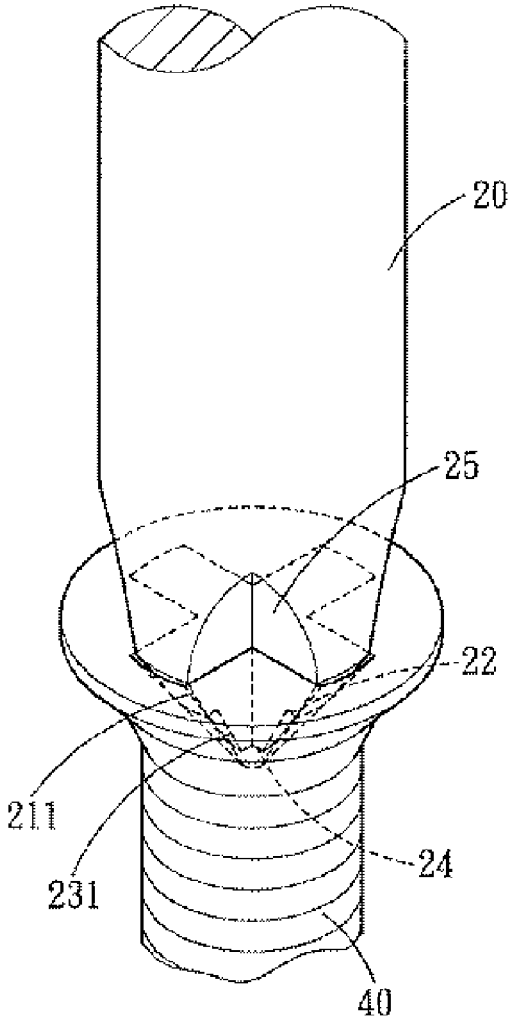
FIG. 5 is a perspective view of showing the compound cross-shaped screwdriver head screwing and unscrewing a bigger bolt.

Similarly, the screwing and unscrewing of the bigger bolt as shown in FIG. 5, the first abutting surface 211 of the first working portion 21 is engaged with the screw groove of a bigger bolt 40 for screwing and unscrewing.

Figure 6:
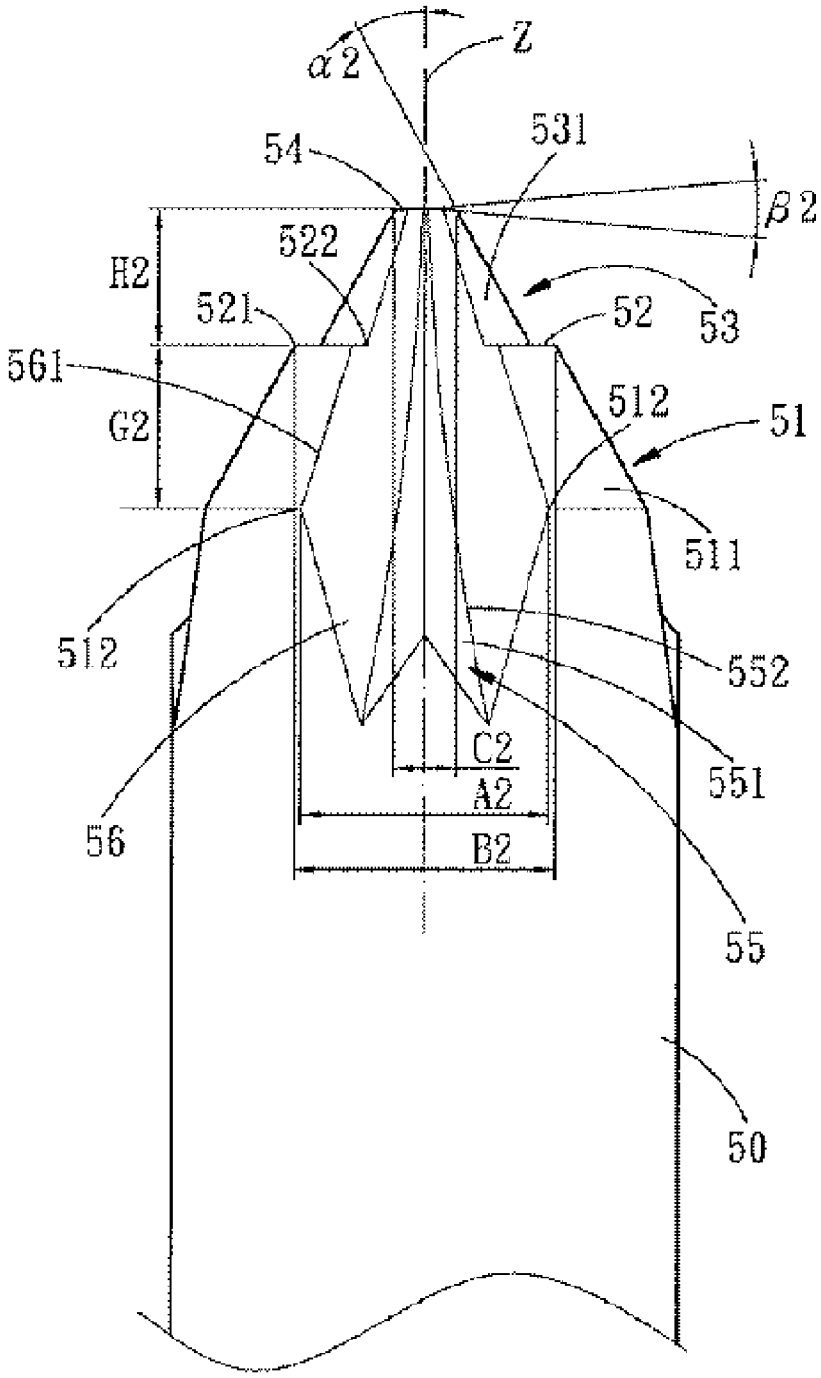
FIG. 6 is a lateral view of a compound *-shaped screwdriver head in accordance with the present invention.
Figure 7:
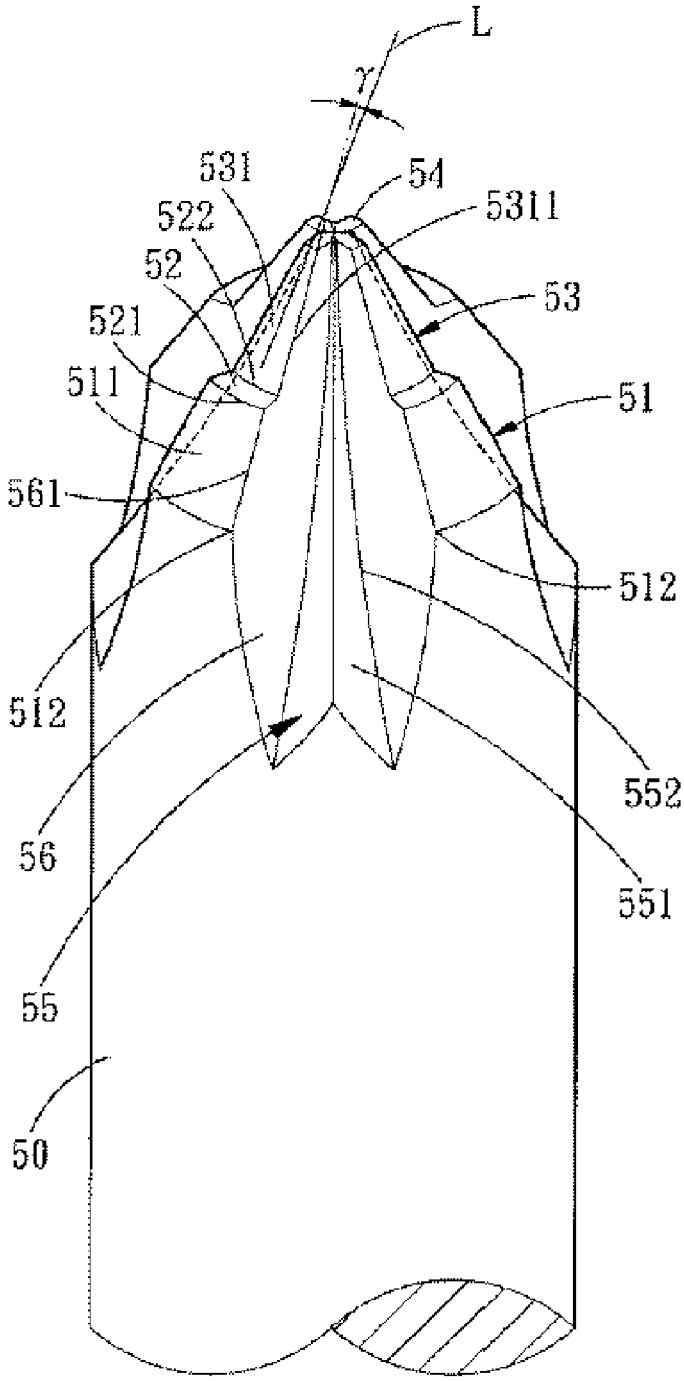
FIG. 7 is a perspective view of the compound *-shaped screwdriver head in accordance with the present invention.

A compound *-shaped (also called Pozidriv) screwdriver head in accordance with another embodiment of the present invention as shown in FIGS. 6 and 7, comprising four first abutting surfaces 511, four second abutting surfaces 531, four third working portions 55 that includes eight third abutting surfaces 551 and eight working grooves 56, the structure of the compound *-shaped screwdriver head is similar to that of the cross-shaped screwdriver head of the first embodiment, and the differences are described as follows:

The compound *-shaped screwdriver head is integrally formed, on the basis of the structure of the compound cross-shaped screwdriver head, at the time the working groove is formed, two working grooves 56 are formed by groove lines 552 of 1.5 to 1.7 mm, the groove lines 552 of the working grooves 56 are approached from the direction of the body 50 to the awl portion 54. A third working portion 55 is protruded out of the two working grooves 56, the adjacent surface of the two working grooves 56 is defined as a third abutting surface 551. The *-shaped screw can be screwed and unscrewed by cooperating the third abutting surface 551 of the third working portion 55 with the first abutting surface 511 of the first working portion 53, similarly, small screw can be screwed and unscrewed by cooperating the third abutting surface 551 of the third working portion 55 with the second abutting surface 531 of the second working portion 53.

The included angles a2 formed between the first abutting surfaces 511 and the center line Z of the body 50 is 26 to 28 degree preferably; the angle a2 formed between the second abutting surface 531 and the center line Z of the body 50 is 26 to 28 degree preferably. The height G2 of the first abutting surface 511 is 1.9 to 2.1 mm preferably, and the height H2 of the second abutting surface 531 is 1.95 to 2.35 mm preferably, and 2.0 to 2.3 mm optimally. The width of the first and the second abutting surfaces 511, 531 are 0.4 to 0.7 mm. The included angle γ between a groove edge 561 located between the groove 56 and the first abutting surface 511 and the axis of symmetry L of the first abutting surface 511 is 4 to 8 degree. The biggest width A2 of the ends of the adjacent first abutting surfaces 511 is 3.0 to 4.1 mm preferably, and 3.5 to 3.6 mm optimally. The biggest width B2 of the outer rings 521 the adjacent connecting surfaces 52 is 3.8 to 5.0 mm preferably, and 4.3 to 4.5 mm optimally. The angle β2 of the awl portion 54 is 5 to 15 degree preferably, and 10 degree optimally. The size C2 of the tip portion of the awl portion 54 is 1.1 to 1.2 mm preferably.

A compound *-shaped (also called star-shaped) screwdriver head in accordance with a further embodiment of the present invention, the awl portion of this screwdriver head is *-shaped from a top view, comprises six first abutting surfaces, six second abutting surfaces and six working grooves.

The present invention is characterized in that the screwdriver head is designed to have a first working portion and a second working portion that are different in diameter, the first working portion is designed for small size screws, and the second working portion is particularly designed for large size screws. Therefore, the screwdriver head is applicable to different sized skewers.

While we have shown and described various embodiments in accordance with the present invention, it should be clear to those skilled in the art that further embodiments may be made without departing from the scope of the present invention.

What is claimed is:

1. A compound screwdriver head, comprising a body, a first working portion, a second working portion, an awl portion and a plurality of working grooves, one end of the first working portion positioned on the body, the other end formed with the second working portion, the awl portion disposed at one end of the second working portion;

the first working portion including a plurality of first abutting surfaces, the second working portion including a plurality of abutting surfaces that parallel to the first abutting surfaces respectively, and the first and second abutting surfaces being connected by a connecting surface having an outer ring and an inner ring, the second and first abutting surfaces being connected by the inner ring and the outer ring respectively, and the size of the outer ring being larger than that of the inner ring;

wherein first working portion is designed for small size screws, and the second working portion is particularly designed for large size screws.

2. The compound screwdriver head as claimed in claim 1, wherein the screwdriver is cross-shaped, an angle between the first abutting surface and the center line of the body is 26 to 30 degree; an angle between the second abutting surface and the center line of the body is 26 to 30 degree.

3. The compound screwdriver head as claimed in claim 2, wherein the height of the first abutting surface is 1.85 to 2.15 mm.

4. The compound screwdriver head as claimed in claim 2, wherein the height of the second working portion is 1.95 to 2.35 mm.

5. The compound screwdriver head as claimed in claim 2, wherein the width of the connecting portion of the first working portion and the body that connected with the groove surface of the working groove is 3.0 to 4.1 mm.

6. The compound screwdriver head as claimed in claim 2, wherein the biggest width of the outer ring of the adjacent connecting surfaces is 3.8 to 5.0 mm.

7. The compound screwdriver head as claimed in claim 2, wherein angle of the awl portion is 5 to 15 degree.

8. The compound screwdriver head as claimed in claim 2, wherein the size of the top end of the awl portion is 1.1 to 1.2 mm preferably.

9. The compound screwdriver head as claimed in claim 1, wherein the screwdriver head is *-shaped from a top view, and includes six working grooves, six first abutting surfaces and six second abutting surfaces.

10. The compound screwdriver head as claimed in claim 1, wherein the screwdriver head is *-shaped from a top view, and includes four first working surfaces, four second working surfaces, eight third abutting surfaces and eight working grooves.

11. The compound screwdriver head as claimed in claim 10, wherein an angle between the first abutting surface and the center line of the body is 26 to 28 degree preferably, an angle between the second abutting surface and the center line of the body is 26 to 28 degree preferably.

12. The compound screwdriver head as claimed in claim 10, wherein the height of the first working portion is 1.9 to 2.1 mm preferably.

13. The compound screwdriver head as claimed in claim 10, wherein the height of the second working portion is 1.95 to 2.35 mm.

14. The compound screwdriver head as claimed in claim 10, wherein the width of the first and second abutting surfaces are between 0.4 to 0.7 mm.

15. The compound screwdriver head as claimed in claim 10, wherein an angle between a groove edge located between the working groove and the first abutting surface and the axis of symmetry of the first abutting surface is 4 to 8 degree.

16. The compound screwdriver head as claimed in claim 10, wherein the biggest width of the ends of the adjacent first working portions is 3.0 to 4.1 mm.

17. The compound screwdriver head as claimed in claim 10, wherein the biggest width of the adjacent connecting surfaces is 3.8 to 5.0 mm.

18. The compound screwdriver head as claimed in claim 10, wherein an angle of the awl portion is 5 to 15 degree.

19. The compound screwdriver head as claimed in claim 10, wherein the size of the top end of the awl portion is 1.1 to 1.2 mm preferably.

* * * * *